US005273166A

United States Patent [19]

Sawamura

[11] Patent Number: 5,273,166

[45] Date of Patent: Dec. 28, 1993

[54] APPARATUS FOR SORTING OPAQUE FOREIGN ARTICLE FROM AMONG TRANSPARENT BODIES

[75] Inventor: Masaki Sawamura, Kanagawa, Japan

[73] Assignee: Toyo Glass Company Limited, Tokyo, Japan

[21] Appl. No.: 818,763

[22] Filed: Jan. 13, 1992

[51] Int. Cl.[5] ..... B07C 5/00

[52] U.S. Cl. ..... 209/587; 209/639; 209/644; 198/638

[58] Field of Search ..... 209/576, 577, 580, 587, 209/588, 638, 644, 657, 917, 639; 198/638

[56] References Cited

U.S. PATENT DOCUMENTS

| | | | |
|---|---|---|---|
| 3,075,641 | 1/1963 | Hutter et al. | 209/639 |
| 3,216,567 | 11/1965 | Kelly et al. | 209/639 |
| 3,581,888 | 6/1971 | Kelly et al. | 209/587 |
| 3,701,419 | 10/1972 | Hutter et al. | 209/644 |
| 3,756,404 | 9/1973 | King et al. | 209/644 |
| 3,977,526 | 8/1976 | Gordon et al. | 209/587 |
| 3,980,181 | 9/1976 | Hoover et al. | 209/657 |
| 4,122,952 | 10/1978 | Richards | 209/587 |
| 4,168,005 | 9/1979 | Sandbank | 209/657 |
| 4,281,764 | 8/1981 | Fowler, Jr. | 209/657 |
| 4,324,336 | 4/1982 | Sandbank | 209/638 |
| 4,373,638 | 2/1983 | Schapper | 209/570 |
| 4,385,700 | 5/1983 | Hodges et al. | 209/657 |
| 4,901,861 | 2/1990 | Cicchelli | 209/588 |
| 4,909,930 | 3/1990 | Cole | 209/639 |

FOREIGN PATENT DOCUMENTS

| | | | |
|---|---|---|---|
| 353457 | 2/1990 | European Pat. Off. | 209/644 |
| 0413522 | 2/1991 | European Pat. Off. . | |
| 3443476 | 5/1986 | Fed. Rep. of Germany | 209/639 |
| 452370 | 4/1975 | U.S.S.R. | 209/587 |
| 848100 | 7/1981 | U.S.S.R. | 209/657 |
| 939085 | 6/1982 | U.S.S.R. | 209/587 |

*Primary Examiner*—Robert P. Olszewski
*Assistant Examiner*—Steven M. Reiss
*Attorney, Agent, or Firm*—Sughrue, Mion, Zinn, Macpeak & Seas

[57] ABSTRACT

An opaque foreign article sorting apparatus which can sort an opaque foreign article during dropping from a conveyor precisely with a high degree of accuracy. Objects including transparent bodies in which opaque foreign articles may mix are scanned, during dropping, horizontally linearly with a laser beam, and reflected light is detected by a CCD image sensor. Whether an object scanned is a transparent body or an opaque foreign article is judged at each CCD block including N CCDs, and when an opaque foreign article is judged at a CCD block, air is jetted from a corresponding nozzle block and adjacent nozzle blocks to blow off the object.

5 Claims, 10 Drawing Sheets

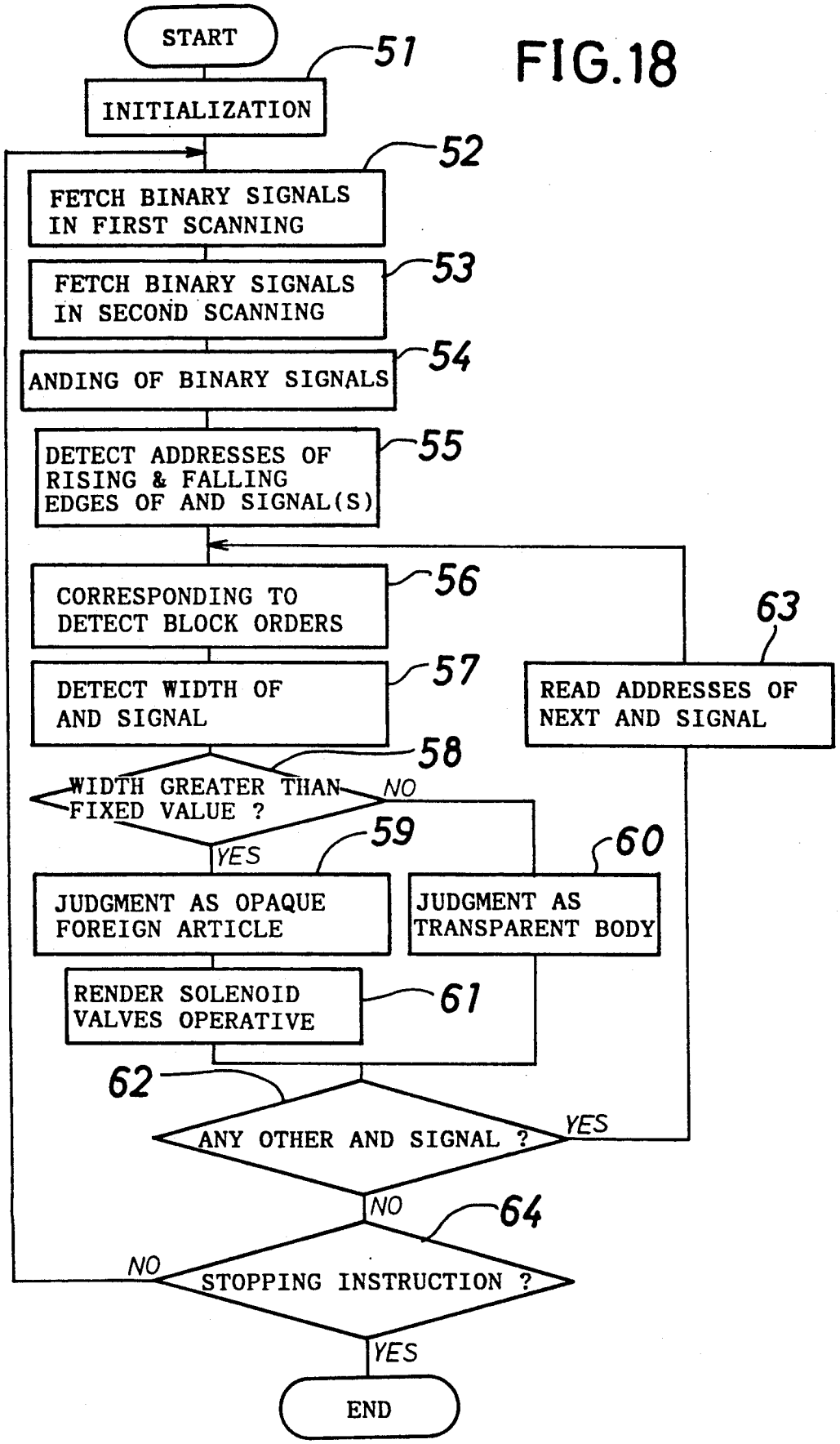
FIG.18
START
51
INITIALIZATION
52
FETCH BINARY SIGNALS IN FIRST SCANNING
53
FETCH BINARY SIGNALS IN SECOND SCANNING
54
ANDING OF BINARY SIGNALS
55
DETECT ADDRESSES OF RISING & FALLING EDGES OF AND SIGNAL(S)
56
CORRESPONDING TO DETECT BLOCK ORDERS
57
DETECT WIDTH OF AND SIGNAL
63
READ ADDRESSES OF NEXT AND SIGNAL
58
WIDTH GREATER THAN FIXED VALUE ?
NO
YES
59
JUDGMENT AS OPAQUE FOREIGN ARTICLE
60
JUDGMENT AS TRANSPARENT BODY
61
RENDER SOLENOID VALVES OPERATIVE
62
ANY OTHER AND SIGNAL ?
YES
NO
64
STOPPING INSTRUCTION ?
NO
YES
END

APPARATUS FOR SORTING OPAQUE FOREIGN ARTICLE FROM AMONG TRANSPARENT BODIES

BACKGROUND OF THE INVENTION

1. Field of the Invention

This invention relates to an apparatus for sorting an opaque foreign article from among transparent bodies, and more particularly to an apparatus for sorting an opaque foreign article such as a pebble or a ceramic piece from among a large number of transparent bodies such as glass pieces of recovered cullets.

2. Description of the Prior Art

An apparatus of the type mentioned has been proposed by the inventor of the present invention and is disclosed in European Patent Application Publication No. 0 413 522 A2. In the apparatus, objects including transparent bodies in which opaque foreign articles may mix are transported on a conveyor and then allowed to drop individually from the conveyor, and then while they are dropping, they are scanned horizontally along a straight line with a linearly polarized laser beam and reflected light is detected by means of a CCD (charge coupled device) image sensor by way of a polarizing filter. Whether the object scanned is a transparent body or an opaque foreign article is judged from outputs of CCDs of the image sensor.

In particular, when the object scanned is a transparent body, most of the laser beam passes through the object while only a small part of the laser beam is reflected by the object, and since such reflected light remains as linearly polarized light, it is intercepted by the polarizing filter. On the other hand, when the object scanned is an opaque foreign article, the laser beam is irregularly reflected by the object to change into circularly polarized light and most of it passes through the polarizing filter so that it falls incident on the image sensor. Accordingly, when the object scanned is a transparent body, a CCD of the image sensor will provide a comparatively low output level, but when the object scanned is an opaque foreign article, such CCD will provide a comparatively high output level. Therefore, a transparent body and an opaque foreign article can be distinguished from each other in accordance with a difference between output levels of a CCD. Then, in case the object has been judged as an opaque foreign article, air will be jetted to the object during dropping from the conveyor to blow off and separate it from the other transparent bodies.

SUMMARY OF THE INVENTION

It is an object of the present invention to provide an opaque foreign article sorting apparatus by which separation of an opaque foreign article during dropping from a transporting mechanism can be performed precisely with a high degree of accuracy.

In order to attain the object, according to the present invention, there is provided an apparatus for sorting an opaque foreign article from amongst a plurality of transparent bodies, which has moving means for moving the objects individually past a scanning line, means for scanning the object on the scanning line with a beam of light, optical sensing means including a plurality of solid state image pickup elements for detecting the light reflected from the object on the scanning line, a plurality of nozzle elements arranged in a row parallel to the scanning line such that each of the nozzle elements corresponds to a set of N solid state image pickup elements of the optical sensing means, N being a positive integral number, a single air supplying source, a plurality of valves provided in a one-to-one corresponding relationship to the nozzle elements and individually controllable to jet air from the air supplying source therethrough, judging means for detecting outputs of the solid state image pickup elements and judging, for each of the sets of the solid state image pickup elements, whether the object on the scanning line is a transparent body or an opaque foreign article, and valve controlling means for controlling the valves so that, when the object is judged as an opaque foreign article at a particular one of the sets of the solid state image pickup elements by the judging means, air may be jetted from one of the nozzle elements corresponding to the particular one set and adjacent ones of the nozzle elements on the opposite sides of the one nozzle element to blow off the object.

With the opaque foreign article sorting apparatus, when objects including transparent bodies in which opaque foreign articles may mix pass the scanning line, they are optically detected by one of the solid state image pickup elements of the optical sensing means. Then, whether an object passing the scanning line is a transparent body or an opaque foreign article and which region of the scanning line the object passes are judged by the judging means. Then, in case the object is an opaque foreign article, air is jetted not only from a nozzle element corresponding to the region the object passes but also from adjacent nozzle elements on the opposite sides of the nozzle element to blow off the opaque foreign article. Consequently, even if such opaque foreign article makes some irregular motion or changes its moving direction during movement thereof, it can still be sorted precisely.

Preferably, each of the nozzle elements has a nozzle elongated in the direction of the row of the nozzle elements. Thus, the directivity in jetting of air toward an opaque foreign article is improved.

Preferably, the moving means includes a belt conveyor having a plurality of convex and concave portions formed on a surface thereof on which the objects are transported. Thus, objects being moved by the belt conveyor can be separated well from the belt conveyor, and consequently, they pass the scanning line only within a limited lateral range, which improves the accuracy in detection by the optical sensing means.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIG. 18 is a flow chart illustrating operation of a computer of the opaque foreign article sorting apparatus of FIG. 15.

DESCRIPTION OF THE PREFERRED EMBODIMENT

Figure 1:
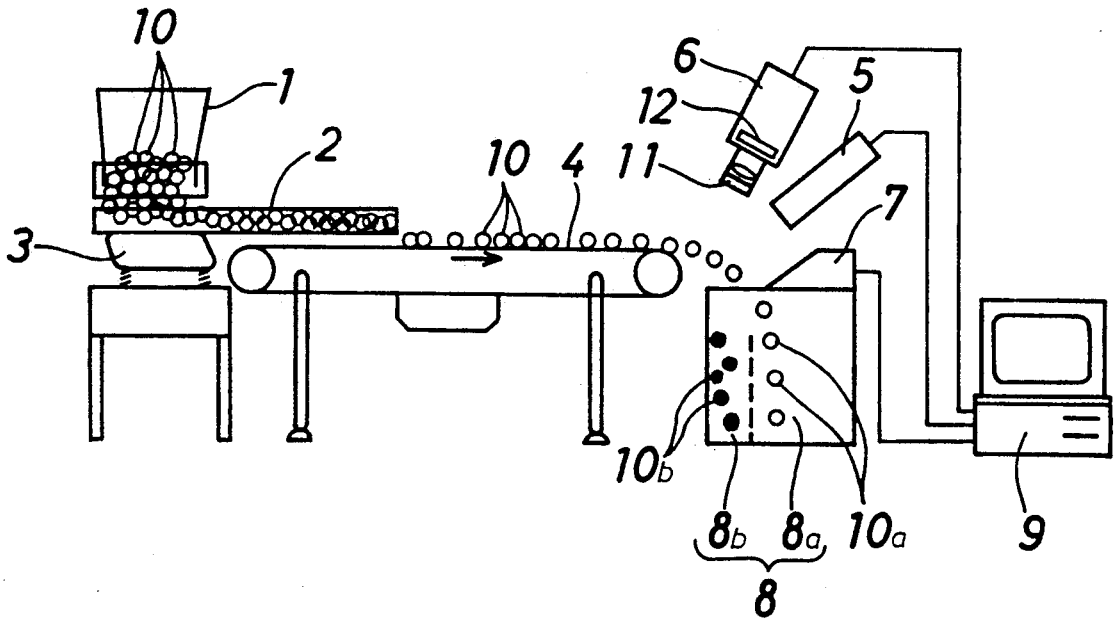
FIG. 1 is a schematic diagrammatic representation of an opaque foreign article sorting apparatus showing a preferred embodiment of the present invention.

Referring now to FIG. 1, there is shown a general arrangement of an opaque foreign article sorting apparatus to which the present invention is applied. The opaque foreign article sorting apparatus includes a hopper 1, a dispersing feeder 2, a vibrator 3, a belt conveyor 4, a laser beam scanning apparatus 5, a CCD camera 6, an air jetting apparatus 7, a recovering vessel 8 and a computer 9.

A large number of objects 10 including transparent bodies of cullets or the like in which opaque foreign articles such as pebbles or ceramic pieces may mix are thrown into the hopper 1 and then supplied onto the dispersing feeder 2. The objects 10 are transported while being dispersed on the diffusing feeder 2 which is being vibrated by the vibrator 3, and are then transferred to the belt conveyor 4. Then, the objects 10 are transported on the belt conveyor 4 until they dispersively drop from the belt conveyor 4 at a last end of the travel thereof by the belt conveyor 4. While they are dropping, they are scanned horizontally along a straight scanning line by the laser beam scanning apparatus 5, and reflected light from them is detected by a CCD image sensor 12 of the CCD camera 6 by way of a polarizing filter 11. Outputs of the image sensor 12 are analyzed by the computer 9 to judge whether the individual objects scanned are transparent bodies or opaque foreign articles, and the air jetting apparatus 7 is controlled by the computer 9 in accordance with such judgment. Then, in case an object 10 is judged as a transparent body 10*a*, it is allowed to drop into a transparent body recovering section 8*a* of the recovering vessel 8, but on the contrary in case the object 10 is judged as an opaque foreign article 10*b*, air is jetted from the air jetting apparatus 7 to blow off the opaque foreign article 10*b* so that it may drop into a foreign article recovering section 8*b* of the recovering vessel 8.

Figure 2:
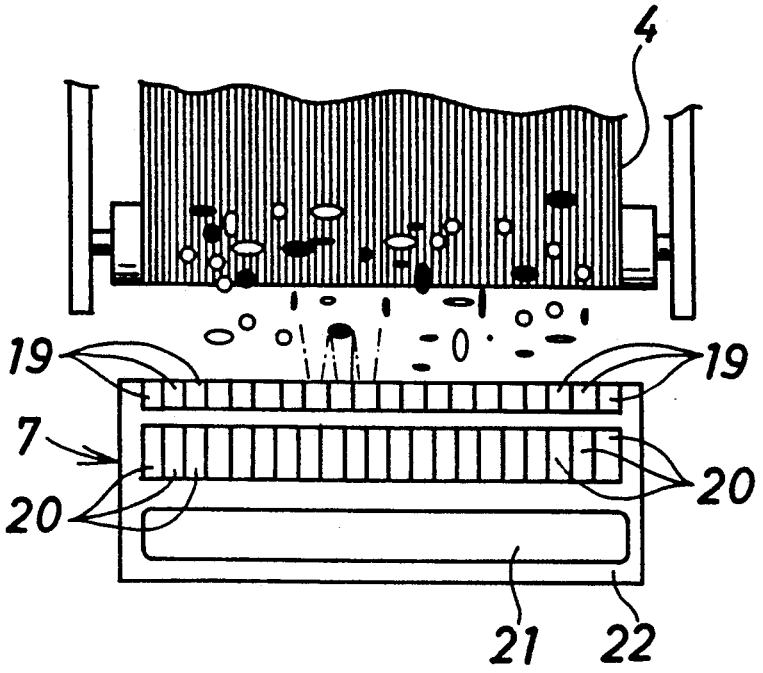
FIG. 2 is a schematic plan view of a belt conveyor and an air jetting apparatus of the opaque foreign article sorting apparatus of FIG. 1.
Figure 4:
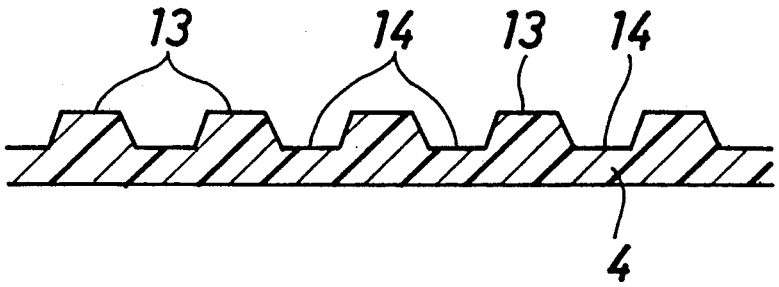
FIG. 4 is an enlarged sectional view of the belt conveyor shown in FIG. 2.

The belt conveyor 4 has a large number of convex portions and concave portions in the form of ribs 13 and grooves 14, respectively, formed alternately in a transverse or widthwise direction on a transporting surface thereof such that they extend in a longitudinal direction of the belt conveyor 4 which coincides with a transporting direction of the belt conveyor 4 as shown in FIGS. 2 and 4. The reason why the belt conveyor 4 has such uneven transporting surface is that it is intended to assure effective separation of objects 10 from the belt conveyor 4 and also to assure regular separation of such objects 10 so that loci of the objects 10 dropping from the belt conveyor 4 may not separate to a great extent in forward and backward directions. If such loci otherwise separate to a great extent in the forward and backward directions, then detection of the objects 10 by means of the laser beam scanning apparatus 5 and the CCD camera 6 and separation of the objects by air from the air jetting apparatus 7 cannot be performed precisely.

Figure 5:
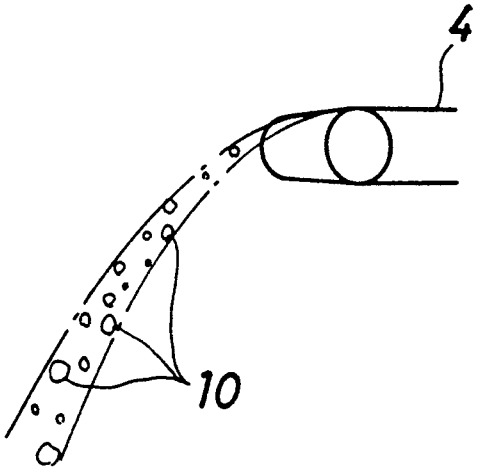
FIG. 5 is a side elevational view showing loci of objects dropping from a belt conveyor having an uneven conveying surface.
Figure 6:
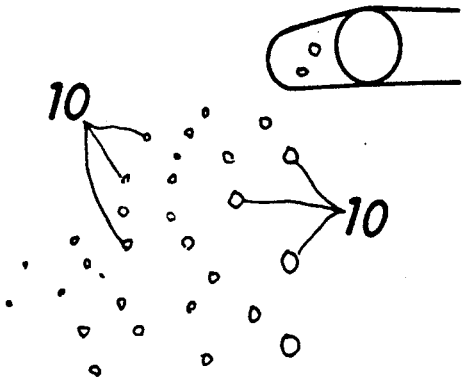
FIG. 6 is view similar to FIG. 5 but showing loci of objects dropping from another belt conveyor which does not have an uneven conveying surface.

Dropping loci from the belt conveyor 4 having such an uneven conveying surface as shown in FIG. 4 and dropping loci from another belt conveyor having a mere flat conveying surface were examined by an experiment. The experiment proved that, from the conveyor 4 having such uneven conveying surface, objects 10 drop along substantially same loci as seen from FIG. 5, but from the conveyor having the flat conveying surface, objects 10 drop very at random in the forward and backward directions as illustrated in FIG. 6.

Figure 7:
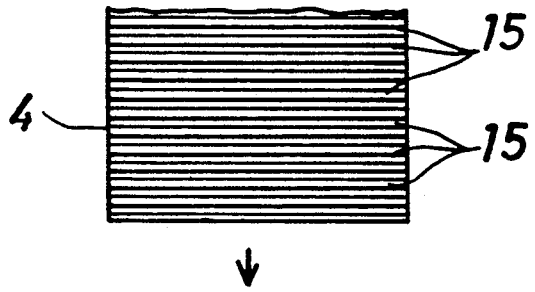
FIG. 7 is a plan view of a belt conveyor having transversely extending ribs formed on a conveying surface thereof.
Figure 8:
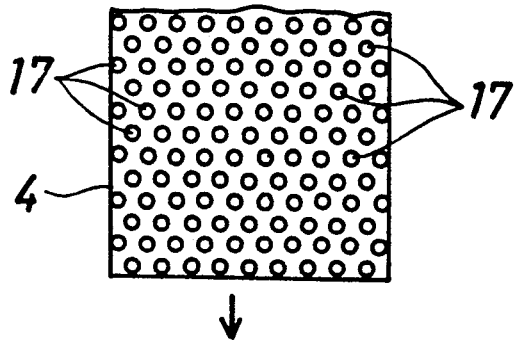
FIG. 8 is a plan view of another belt conveyor having a large number of cylindrical projections formed in a zigzag pattern on a conveying surface thereof.
Figure 9:
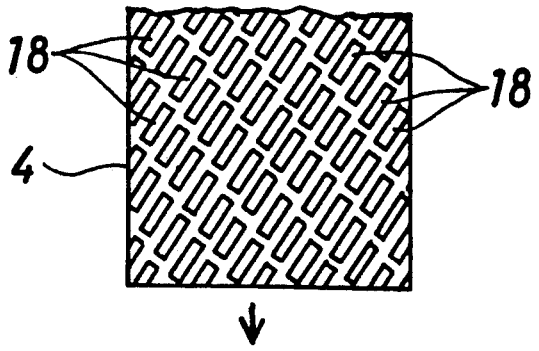
FIG. 9 is a plan view of a further belt conveyor having a large number of obliquely extending intermittent ribs formed on a conveying surface thereof.

It is to be noted that the conveying surface of the belt conveyor 4 may have an uneven profile other than that shown in FIGS. 2 and 4. For example, the conveying surface of the belt conveyor 4 may have a profile as shown in FIG. 7 wherein it has a large number of ribs 15 and grooves 16 formed alternately in a longitudinal direction thereon such that they extend in a widthwise direction of the belt conveyor 4. Or, the conveying surface may have a profile as shown in FIG. 8 wherein it has a large number of cylindrical projections 17 formed in a zigzag pattern thereon. Or else, it may have a profile as shown in FIG. 9 wherein it has a large number of oblique intermittent ribs or projections 18 formed thereon.

Figure 10:
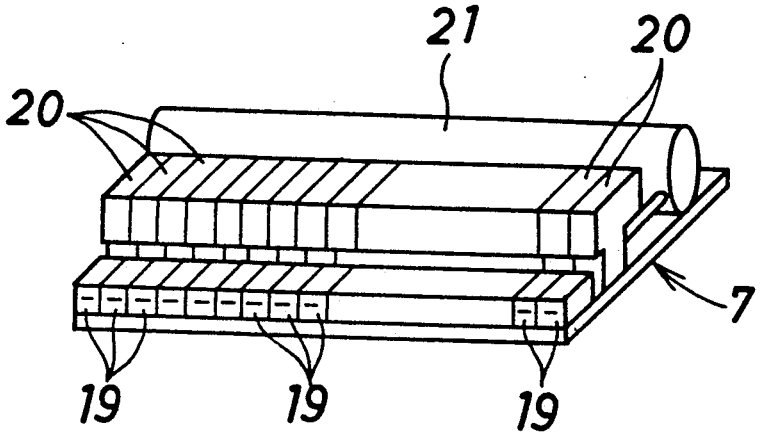
FIG. 10 is a perspective view of the air jetting apparatus of FIG. 2.
Figure 11:
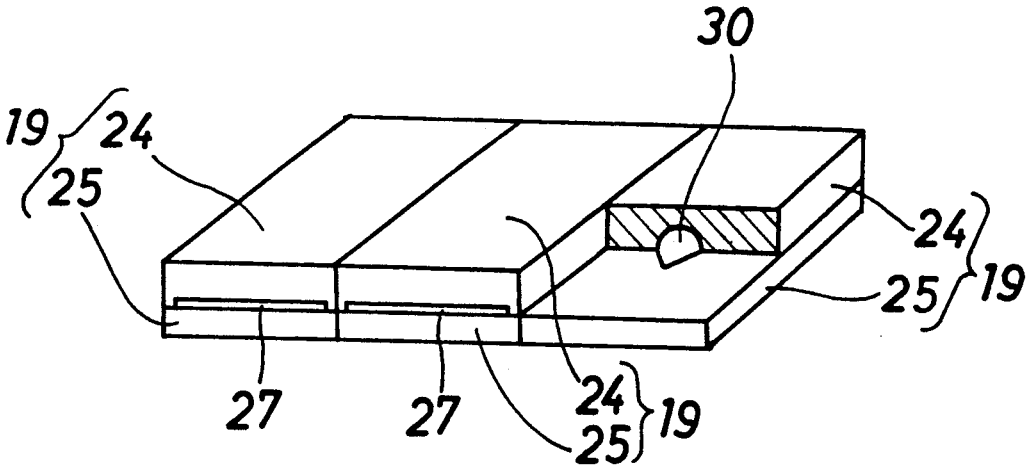
FIG. 11 is a perspective view, partly broken, of a nozzle block of the air jetting apparatus of FIG. 10.
Figure 12:
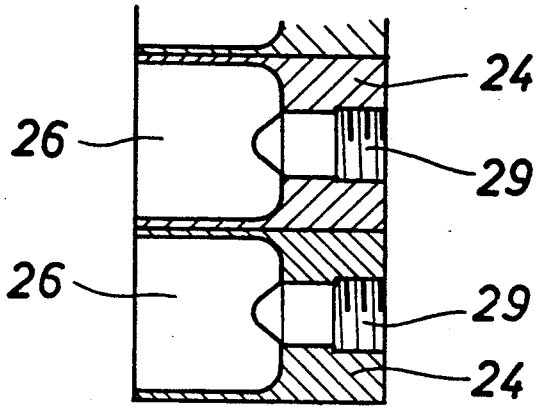
FIG. 12 is a horizontal sectional view of the nozzle block of FIG. 11.
Figure 13:
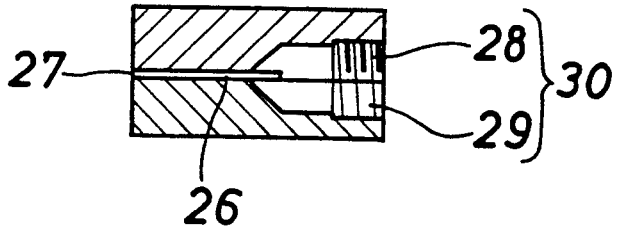
FIG. 13 is a vertical setional view of the nozzle block of FIG. 11.
Figure 14:
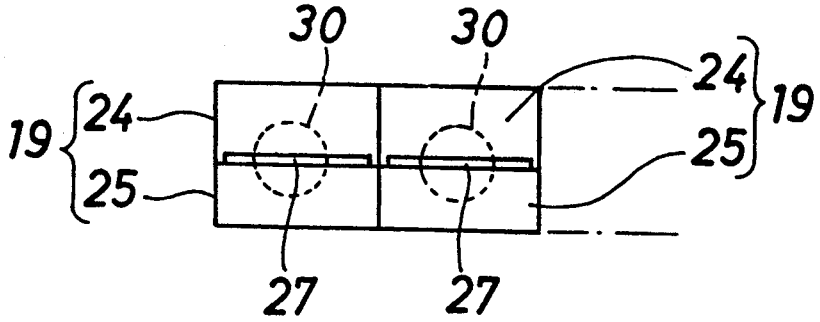
FIG. 14 is a front elevational view of the nozzle block of FIG. 11.

Referring now to FIGS. 2 and 10, the air jetting apparatus 7 includes a base 22, a plurality of, for example, 20, nozzle blocks 19 juxtaposed in a horizontal row on the base 22, a same number of solenoid valves 20 juxtaposed similarly in a horizontal row on the base 22 in a one-to-one relationship with the nozzle blocks 19, and a single receiver tank 21 disposed on the base 22. The air jetting apparatus 7 is installed in an inclined relationship on a platform 23 as shown in FIG. 3 so that it may jet air from an oblique upper position toward an opaque foreign article 10*b* dropping from the belt conveyor 4.

Referring now to FIGS. 11 to 14, a structure of the nozzle blocks 19 is shown. Each of the nozzle blocks 19 is composed of a pair of upper and lower rectangular plates 24 and 25 of a same size placed one on the other.

The upper plate 24 has a shallow recess 26 formed at a front portion of a lower face thereof such that it extends to a front end face of the plate 24, but the lower plate 25 does not have such a recess thereon. The upper plate 24 is thus placed on the lower plate 25 to close the bottom of the recess 26 thereof with the lower plate 25 to define, at the front end face of the nozzle block 19, a nozzle 27 which is elongated in a direction in which the nozzle blocks 29 are arranged in a horizontal row. The upper and lower plates 24 and 25 have semicircular threaded grooves 28 and 29 formed at rear portions of lower and upper faces thereof, respectively, such that they extend to rear end faces of the upper and lower plates 24 and 25. Thus, when the upper and lower plates 24 and 25 are assembled to each other, the upper and lower semicircular threaded grooves 28 and 29 thereof cooperate with each other to complete a connecting threaded hole 30 for the connection to a corresponding one of the solenoid valves 20. The threaded hole 30 communicates with the nozzle 27 by way of the recess 26 of the upper plate 24.

Figure 3:
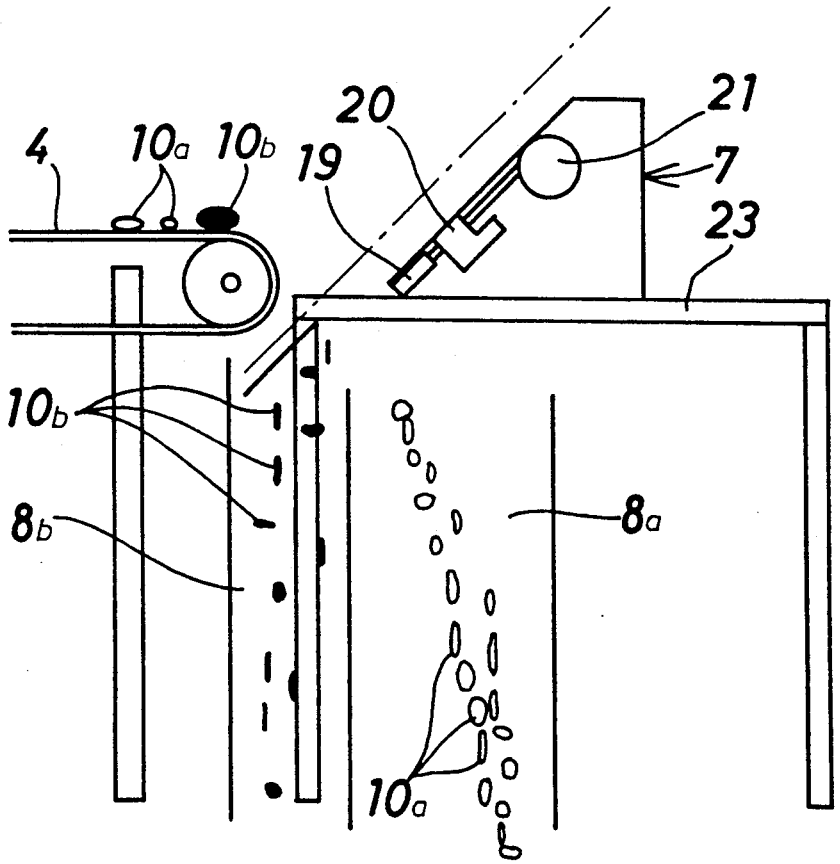
FIG. 3 is a schematic side elevational view of the belt conveyor and the air jetting apparatus of FIG. 2.

Referring to FIGS. 2, 3 and 10, the receiver tank 21 is connected to a compressor (not shown), and compressed air stored in the receiver tank 21 is supplied simultaneously into the twenty solenoid valves 20 by way of pipes (not shown). Accordingly, if one of the solenoid valves 20 is opened, then air is jetted from the elongated nozzle 27 of a corresponding one of the nozzle blocks 19.

Figure 15:
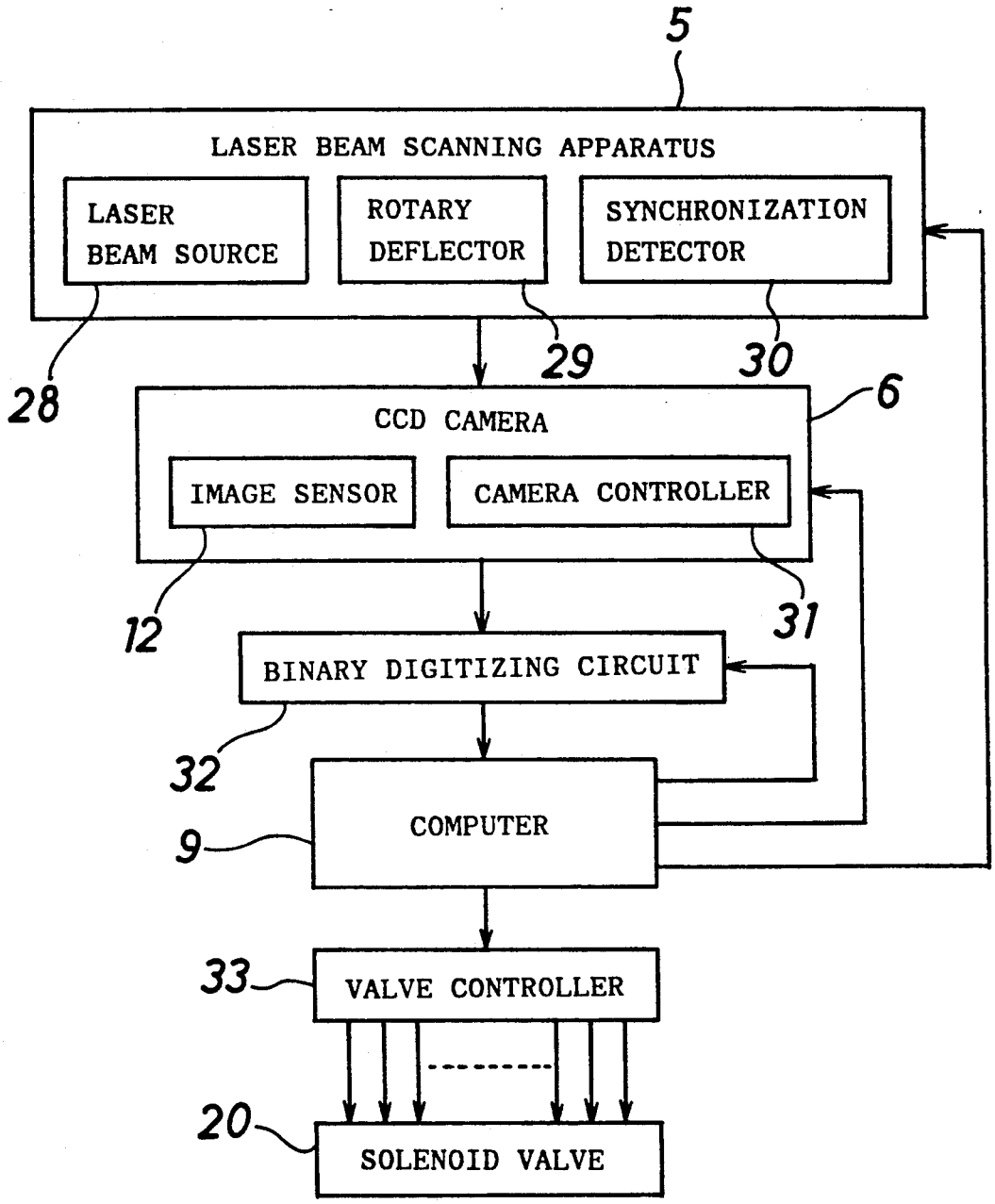
FIG. 15 is a block diagram showing general electric construction of the opaque foreign article sorting apparatus of FIG. 1.

Referring now to FIG. 15, general electric construction of the opaque foreign article sorting apparatus is shown. The laser beam scanning apparatus 5 includes a laser beam source 28, a rotary deflector 29 and a synchronization detector 30. A laser beam emitted from the laser beam source 28 is reflected by a rotating polygon mirror of the rotary deflector 29 to make a scanning laser beam for scanning along a predetermined horizontal straight line. Such a scanning laser beam is repetitively projected from the laser beam scanning apparatus 5 as the polygon mirror of the rotary deflector 29 rotates. The scanning laser beam is detected by the synchronization detector 30, and a synchronizing signal is outputted for each scanning stroke or operation from the synchronization detector 30.

The image sensor 12 of the CCD camera 6 may be a so-called one-dimensional image sensor wherein a total of, for example, 1,024 CCDs are arranged in a horizontal row. Outputs of the CCDs of the image sensor 12 are fetched for each scanning operation by a camera controller 31 in response to a synchronizing signal from the synchronization detector 30 of the laser beam scanning apparatus 5. The thus fetched outputs of the CCDs by the camera controller 31 are individually converted into binary electronic signals with reference to a fixed threshold level by a binary digitizing circuit 32 and then fetched into the computer 9, in which they are stored into a memory (not shown). Each of the output voltages of the CCDs depends upon whether an object 10 scanned by a scanning laser beam is a transparent body or an opaque foreign article. In particular, reflected light from an opaque foreign article **10*b* is principally circularly polarized light and passes through the polarizing filter 11 while reflected light from a transparent body 10*a* is low in intensity and linearly polarized light and accordingly in intercepted by the polarizing filter 11. Consequently, an output voltage of each CCD presents a much higher level when the object is an opaque foreign article 10*b* than that when the object is a transparent body 10*a***.

Such difference in voltage level can be made more definite if a same object 10 is scanned by a plurality of times by the laser beam scanning apparatus 5 and outputs of the image sensor 12 in such scanning operations are subjected to an AND operation. Thus, in the present embodiment, each time the laser beam scanning apparatus 5 performs two scanning operations, outputs of the image sensor 12 in the two scanning operations are ANDed after binary digitization thereof.

While the image sensor 12 includes up to 1,024 CCDs in the opaque foreign article sorting apparatus of the present embodiment, the number of the nozzle blocks 19 of the air jetting apparatus 7 is much smaller than the number of the CCDs. Thus, in the present embodiment, for example, up to 51 CCDs are allotted to each of the nozzle blocks 19 such that the total of 1,024 CCDs are divided into 20 blocks so that judgment between a transparent body and an opaque foreign article may be performed for each block including 51 CCDs therein. It is to be noted that, in this instance, since $51 \times 20 = 1{,}020$, four among the total of 1,024 CCDs are in excess, and outputs of two CCDs on each of the opposite ends of the horizontal row of 1,024 CCDs are ignored while outputs of the remaining 1,020 CCDs are regarded as effective.

Further, when an opaque foreign article is judged by a particular CCD block, the solenoid valves 20 are controlled by a valve controller 33 so that air may be jetted not only from one of the nozzle blocks 19 corresponding to the particular CCD block but also from two adjacent ones of the nozzle blocks 19 on the opposite sides of the particular nozzle block 19.

Figure 16:
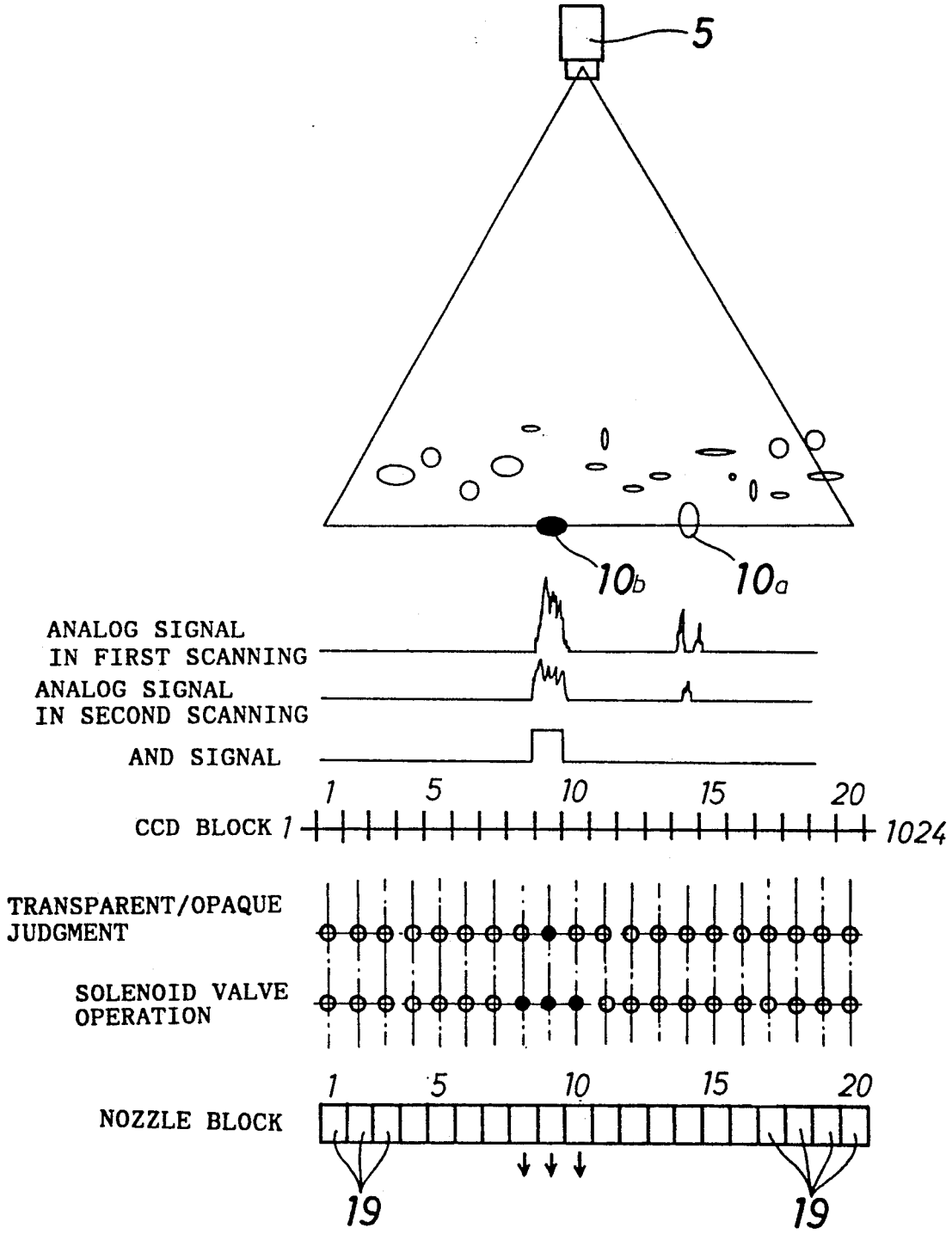
FIG. 16 is a diagrammatic view illustrating operation of the opaque foreign article sorting apparatus of FIG. 15.
Figure 17:
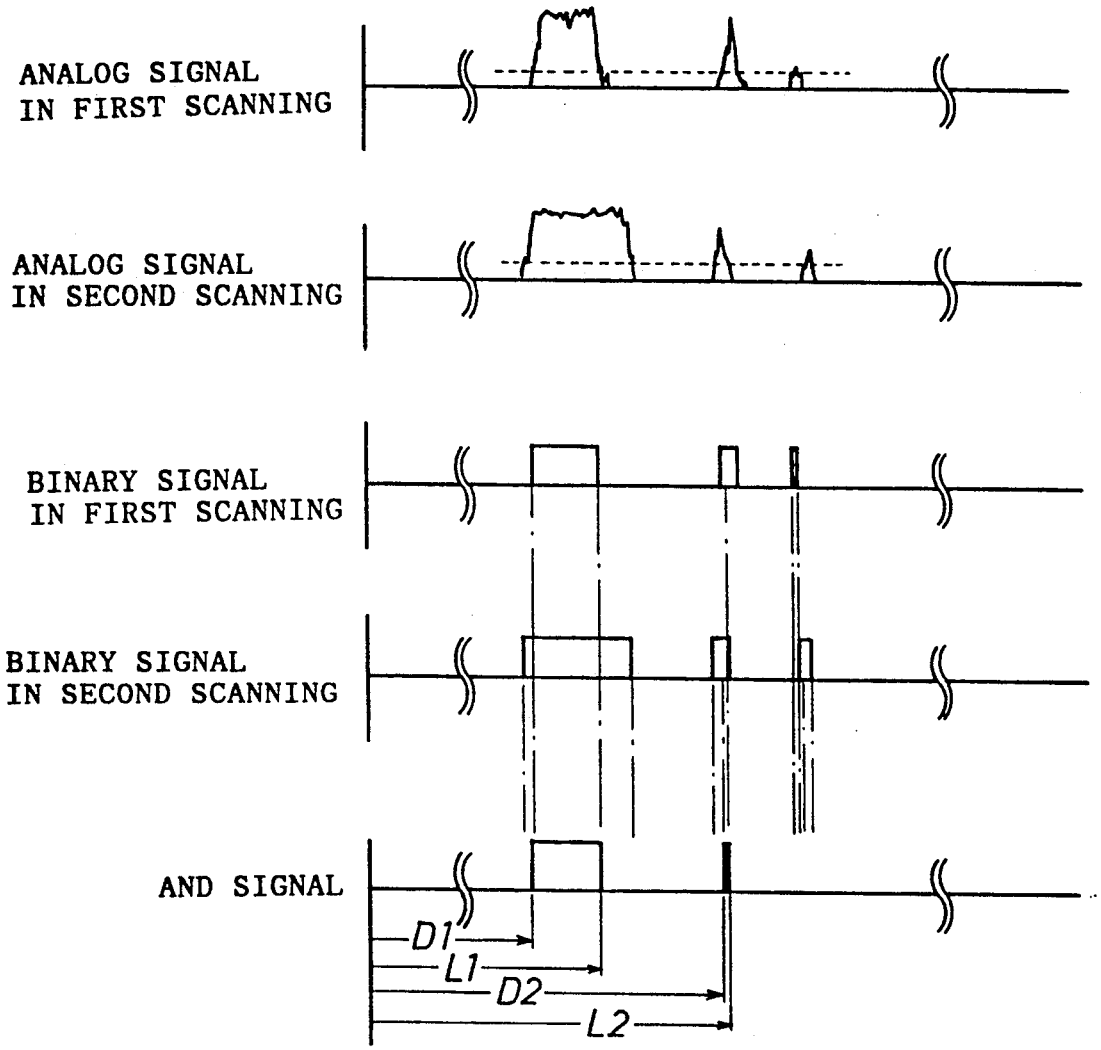
FIG. 17 is a time chart illustrating processing of an output of an image sensor of the opaque foreign article sorting apparatus of FIG. 15.

FIG. 16 illustrates a relationship among scanning of a transparent body **10*a* and an opaque foreign article 10*b* by a laser beam from the laser beam scanning apparatus 5, an analog signal obtained by continuously plotting outputs of the CCDs of the image sensor 12 in a first scanning operation, another analog signal obtained similarly by continuously plotting outputs of the CCDs of the image sensor 12 in a second scanning operation, and AND signal for the same scanning line obtained by ANDing the two analog signals after binary digitization, the 20 CCD blocks, a result of judgment between transparent and opaque, operative or inoperative conditions of the twenty solenoid valves 20, and jetting of air from the twenty nozzle blocks 19. Meanwhile, FIG. 17 shows two analog signals from the CCDs of the image sensor 12 obtained in first and second scanning operations, two binary signals individually obtained by binary digitization of the two analog signals by the binary digitizing circuit 32**, and an AND signal obtained by ANDing the two binary signals.

FIG. 18 illustrates operation executed by the computer 9 to judge whether an object scanned is a transparent body or an opaque foreign article and sort an object judge as an opaque foreign article. Referring to FIG. 18, the computer 9 first initializes itself at step 51. In such initialization, a unit number N of CCDs to be allotted to each of the nozzle blocks 19 ($N=51$ in the embodiment described above) and a reference width T with which a width of a signal obtained by ANDing is compared to judge whether the object scanned is a transparent body or an opaque foreign article are set.

Then at step 52, binary values from the binary digitizing circuit 32 in a first scanning operation are fetched and stored into the memory, and then binary values in a second scanning operation are similarly fetched and stored into the memory at step 53. Then, the binary values for the first and second scanning operations are ANDed to obtain an AND signal or signals at step 54 (AND signal will hereinafter denote a positive pulse portion of the waveform referred to as AND signal in FIGS. 16 or 17 unless specified otherwise). Subsequently, addresses of rising and falling edges of the AND signal are detected for the same predetermined scanning line at step 55. In particular, it is detected for each of the AND signals to which ones of the CCDs arranged in the horizontal row a rising edge and a falling edge of each of the AND signals correspond individually. Then, positions of such CCDs in the arrangement are stored into the memory for each of the AND signals. Further, one of the positions or addresses stored in the memory which has the smallest value among them is detected and addresses of the rising and falling edges of the AND signal of the thus detected position are read out from the memory.

At next step 56, it is determined by the following calculation for each of the rising and falling edges of the AND signal to which one of the CCD blocks and hence to which one of the nozzle blocks each of the rising and falling edges of the AND signal corresponds. In particular, if it is assumed that the address of the rising edge of such AND signal is represented by D1 as shown in FIG. 17, then the order X (integral number) of a nozzle block 19 corresponding to the rising edge of the AND signal is represented, using X and N which is the unit number mentioned hereinabove, as $X=D1/N+1$. If the case of FIG. 16 is taken as an example, then when the unit number N is "51" as described hereinabove, in case the address of the first rising edge D1 is "420", the order X is "9", and accordingly, the address of the first rising edge corresponds to the ninth nozzle block 19.

Subsequently at step 57, a width W between the first rising edge and corresponding falling edge of the AND signal is determined in accordance with a number of CCDs included between the addresses of the rising and falling edges. In particular, if the rising edge address of the first AND signal is represented by D1 as described hereinabove and the falling edge address is represented by L1 as shown in FIG. 16, then the width W of the AND signal is given by $W=L1-D1$.

Then at step 58, it is determined whether or not the width W of the AND signal is greater than the reference width T mentioned hereinabove. Then, if the width W is greater than the reference width T, then the control sequence advances to step 59, at which it is determined that the object scanned is an opaque foreign article. On the contrary, if the width W is judged not greater than the reference width T at step 58, the control sequence advances to step 60, at which it is judged that the object scanned is a transparent body. For example, referring to FIG. 17, if the width W is greater than the reference width T like the first AND signal of which the width $W=L1-D1$ is greater than T, that is, $L1-D1>T$, the object scanned is judged as an opaque foreign article, but otherwise if the width W is not greater than the reference width T like the second AND signal of which the width $W=L2-D2$ is not greater than T, that is, $L2-D2\leqq T$, the object scanned is judged as a transparent body. Then, in case it is determined at step 59 that the object scanned is an opaque foreign article, the control sequence advances to step 61, at which three solenoid valves 20 are selectively rendered operative at a time under the control of the valve controller 33. In particular, the three solenoid valves 30 corresponding to the X-th nozzle block 19 and two adjacent $X-1-$th and $X+1-$th nozzles 19 on the opposite sides of the X-th nozzle block 19 are opened so that air may be jetted simultaneously from the three nozzle blocks 19 toward the opaque foreign article **10*b* to blow off the opaque foreign article 10*b* so that it may drop into the foreign article recovering section 8*b* of the recovering vessel 8 shown in FIG. 3. Since, in the case of FIG. 16, the opaque foreign article is judged at the ninth CCD block, air is jetted from the ninth nozzle block 19 and adjacent eighth and tenth nozzle blocks 19**.

At step 62 to which the control sequence advances from step 60 or 61, it is judged whether or not there remains another AND signal or signals for the same scanning line, and if there remains, the control sequence advances to step 63, at which the rising edge address and the falling edge address of the remaining AND signal or a first one of the remaining AND signals are read out from the memory. After then, the control sequence returns to step 56 to subsequently repeat such operations at steps 56 to 62 as described above.

On the other hand, if there remains no other AND signal for the same scanning line at step 62, then it is judged at step 64 whether there is an instruction to stop scanning of a laser beam. If there is no such stopping instruction, then the control sequence returns to step 52 to thereafter repeat similar operations for next scanning, but if there is such stopping operation, the execution of the program comes to an end.

It is to be noted that, if ANDing of outputs of the image sensor 12 after binary digitization is performed for such outputs in three or more scanning operations, then the accuracy in judgment between a transparent body and an opaque foreign article can be further improved. Further, the image sensor 12 need not be a so-called one-dimensional image sensor wherein solid state image pickup elements such as CCDs are arranged in a horizontal row, but may otherwise be a two-dimensional image sensor wherein solid state image pickup elements are arranged in a matrix.

Further, while air is jetted, in the embodiment described above, at a time from three nozzle blocks including an X-th nozzle block corresponding to a CCD block at which an opaque foreign article is detected and two adjacent $X-1$-th and $X+1$-th nozzle blocks on the opposite sides of the X-th nozzle block, the number of nozzle blocks from which air is jetted can be selected arbitrarily such that, with the width of nozzles of each nozzle block reduced, air is jetted simultaneously also from, for example, $X-2$-th and $X+2$-th nozzle blocks, or the number of nozzle blocks from which air is jetted can be changed in accordance with a width of an AND signal.

Having now fully described the invention, it will be apparent to one of ordinary skill in the art that many changes and modifications can be made thereto without departing from the spirit and scope of the invention as set forth herein.

What is claimed is:

1. An apparatus for sorting an opaque foreign object from amongst a plurality of transparent objects, comprising:

moving means for moving the objects individually past a scanning line;

means for scanning the objects on the scanning line with a beam of light;

optical sensing means including a plurality of solid state image pickup elements for detecting the light reflected from the objects on the scanning line;

a plurality of nozzle elements arranged in a row parallel to the scanning line such that each of said nozzle elements corresponds to a set of N solid state image pickup elements of said optical sensing means, N being a positive integer number;

an air supplying source;

a plurality of valves provided in a one-to-one corresponding relationship to said nozzle elements and individually controllable to jet air from said air supplying source therethrough;

judging means for detecting outputs of said solid state image pickup elements and judging, for each of the sets of said solid state image pickup elements, whether an object in any particular portion of the scanning line is an opaque foreign object; and valve controlling means for controlling said valves so that, when an object is judged as an opaque foreign object at a position anywhere along said scanning line by one of the sets of said solid state image pickup elements by said judging means, air is jetted from one of said nozzle elements which is opposite said particular portion corresponding to the particular one set and adjacent ones of said nozzle elements which are on opposite sides of said one of said nozzle elements to blow the opaque foreign object out of a path of travel of the transparent objects.

2. An apparatus as claimed in claim 1, wherein each of said nozzle elements has a nozzle elongated in the direction of the row of said nozzle elements.

3. An apparatus as claimed in claim 1, wherein said moving means includes a belt conveyor having a plurality of convex and concave portions formed on a surface thereof on which the objects are transported.

4. An apparatus for sorting an opaque foreign article from amongst a plurality of transparent objects, comprising:

moving means for moving the objects individually past a scanning line;

means for scanning the objects on the scanning line with a beam of light;

optical sensing means including a plurality of solid state image pickup elements for detecting the light reflected from the objects on the scanning line;

a plurality of nozzle elements arranged in a row parallel to the scanning line such that each of said nozzle elements corresponds to a set of N solid state image pickup elements of said optical sensing means, N being a positive integer number;

an air supplying source;

a plurality of valves provided in a one-to-one corresponding relationship to said nozzle elements and individually controllable to jet air from said air supplying source therethrough;

judging means for detecting successive outputs of each of said solid state image pickup elements corresponding to successive scans of said scanning means and judging, for each of the sets of said solid state image pickup elements, that an object on the scanning line is an opaque foreign object when successive outputs of a particular one of said sets of said image pickup elements are both of a duration which is longer than a predetermined duration; and valve controlling means for controlling said valves so that, when an object is judged as an opaque foreign article at a particular one of the sets of said solid state image pickup elements by said judging means, air is jetted from one of said nozzle elements which is opposite an area corresponding to the particular one set and adjacent ones of said nozzle elements which are on opposite sides of said one of said nozzle elements to blow the opaque foreign object out of a path of travel of the transparent objects.

5. An apparatus for sorting an opaque foreign object from amongst a plurality of transparent objects, comprising:

moving means for moving the objects individually past a scanning line;

means for scanning the objects on the scanning line with a beam of light;

optical sensing means including a plurality of solid state image pickup elements for detecting the light reflected from the objects on the scanning line;

a plurality of nozzle elements arranged in a row parallel to the scanning line such that each of said nozzle elements corresponds to a set of N solid state image pickup elements of said optical sensing means, N being a positive integer number;

an air supplying source;

a plurality of valves provided in a one-to-one corresponding relationship to said nozzle elements and individually controllable to jet air from said air supplying source therethrough;

judging means for detecting successive outputs of each of said solid state image pickup elements corresponding to successive scans of said scanning means and judging, for each of the sets of said solid state image pickup elements, that an object on the scanning line is an opaque foreign object when successive outputs of a particular one of said sets of said image pickup elements are both higher than a predetermined level; and valve controlling means for controlling said valves so that, when an object is judged as an opaque foreign object at a particular one of the sets of said solid state image pickup elements by said judging means, air is jetted from one of said nozzle elements which is opposite an area corresponding to the particular one set and adjacent ones of said nozzle elements which are on opposite sides of said one of said nozzle elements to blow the opaque foreign object out of a path of travel of said transparent objects.

* * * * *